US005494067A

United States Patent [19]

Levallois

[11] Patent Number: 5,494,067

[45] Date of Patent: Feb. 27, 1996

[54] DEVICE FOR REGULATING AND DAMPING A MULTIPHASE FLOW

[75] Inventor: Emile Levallois, Courbevoie, France

[73] Assignee: Institut Francais du Petrole, Rueil Malmaison, France

[21] Appl. No.: 370,435

[22] Filed: Jan. 9, 1995

Related U.S. Application Data

[62] Division of Ser. No. 997,534, Dec. 28, 1992, Pat. No. 5,421,357.

[30] Foreign Application Priority Data

Dec. 27, 1991 [FR] France ..... 91 16231
Aug. 11, 1992 [FR] France ..... 92 09642

[51] Int. Cl.[6] ..... G05D 11/03
[52] U.S. Cl. ..... 137/154; 261/76; 261/DIG. 75
[58] Field of Search ..... 137/154; 261/76, 261/DIG. 75

[56] References Cited

U.S. PATENT DOCUMENTS 5,035,842 7/1991 Mohn ..... 261/DIG. 75 X
5,135,684 8/1972 Mohn et al. ..... 261/DIG. 75 X
5,254,292 10/1993 Gabryelczyk et al. ..... 261/DIG. 75 X

*Primary Examiner*—Gerald A. Michalsky
*Attorney, Agent, or Firm*—Antonelli, Terry, Stout & Kraus

[57] ABSTRACT

The characteristics of a device for regulating and damping the composition fluctuations of a multiphase flow comprising a tank or surge drum and a sample tube located between a source of effluents and a multiphase pump are optimized by selecting the volume of the tank and the distribution of the apertures of the sample tube so as to define an average level around which the level of the liquid-gas interface is stabilized and so that the volume of the liquid phase corresponding to this average level is at least equal to the volume of liquid necessary to discharge any foreseeable volume of gaseous phase coming from the source of effluents. In case of a large volume of gaseous phase, an unpierced tube is introduced inside the sample tube.

6 Claims, 2 Drawing Sheets

DEVICE FOR REGULATING AND DAMPING A MULTIPHASE FLOW

This application is a Divisional application of application Ser. No. 997,534, filed Dec. 28, 1992, now U.S. Pat. No. 5,421,357.

FIELD OF THE INVENTION

The object of the present invention is to propose a process for optimizing the characteristics of a device for regulating and damping the composition fluctuations of a multiphase flow.

The device may notably be installed between a source of effluents and the inlet of a multiphase type pump allowing a fluid consisting of at least one liquid phase and at least one gaseous phase to be transferred.

The invention may notably be applied to the production of hydrocarbons comprising a gas-liquid mixture, and this production may be performed in an environment of uneasy access, for example at the level of a well head or of a subsea transfer line, or else in the virgin forest.

The invention also applies to the chemical and oil industry, or more generally to all industries using multiphase fluids.

The invention may notably be applied to keep a minimum amount of liquid so as to maintain pumping means in a correct working condition.

It is well-known that conveyance of fluids or effluents of the multiphase type consisting of at least one liquid phase and at least one gaseous phase may require the use of a system for regulating the composition of the fluid located at the inlet of a pump and for enabling to deliver to the pump a fluid whose gas-liquid ratio GLR is compatible with the working characteristics necessary to transfer effluents.

In the present text, unless otherwise stated, the terms upstream and downstream relate to the pump with respect to the direction of flow of the effluents.

BACKGROUND OF THE INVENTION

French patent No. 2,642,539 describes a device allowing sudden variations of liquid and gas flowing into the device to be damped and regulated, particularly on the inflow of gas plugs or liquid, that is in the presence of a large amount of fluid only consisting of the gaseous phase or of the liquid phase. This device comprises a tank or surge drum provided with a sample tube extending over a given height of the tank, this tube being pierced with sampling apertures or openings. The device located at the inlet of a pump thus makes it possible to deliver at the pump a multiphase fluid exhibiting characteristics, particularly relating to the gas phase-liquid phase ratio, compatible with the running of the pump.

However, the prior art does not provide a device having such a size and structure that, on the one hand, an amount of liquid always sufficient to remove at any time a large gas pocket or amount is available and, on the other hand, an optimum GLR value is kept as a function of the characteristics of the multiphase pump located downstream, so that it may apply a sufficient compression onto the effluents to be transferred.

One therefore has to change the device as a function of the evolution in time of the composition of the fluid coming from a source of effluents, as occurs for example during the activity period of oil wells, which leads to considerable operating losses.

SUMMARY OF THE INVENTION

The invention notably overcomes these drawbacks by proposing a process allowing a regulating device comprising a tank and a sample tube to be pre-dimensioned according to the composition of the source of effluents to which it is connected and to the characteristics of a multiphase pump located after the device, so as to have a fluid whose GLR value enables the pump to ensure a compression sufficient to transfer the effluents and so that the amount of liquid located in the device enables discharge of any foreseeable amount of gas likely to enter the tank.

The tube goes through the gas/liquid interface under normal working conditions. Thus, in case of an upright cylindric tube, the latter may be vertical or inclined but not horizontal.

Throughout the text, the term aperture density per tube zone refers to the number of apertures evenly distributed over a single zone.

The process in accordance with the invention makes it possible to optimize a device for regulating and damping the composition fluctuations of a multiphase flow comprising at least one liquid phase and at least one gaseous phase, whose gas-liquid ratio (GLR) is likely to vary within a range defined around an average value, said device being positioned between a source of effluents and a multiphase pump transmitting to the effluents a compression value ($\Delta P$) necessary to the transfer of the effluents, and consisting of a tank or surge drum receiving said multiphase flow, which is provided with at least one sample tube pierced with sampling apertures.

The process is characterized in that the level of the liquid-gas interface is substantially stabilized at an average level defined by selecting the volume of the tank and the distribution of the sampling apertures so that the volume of the liquid phase corresponding to this average level is at least equal to the volume of liquid necessary for said multiphase pump to discharge from the tank any foreseeable volume of gaseous phase coming from the source of effluents and entering the tank.

The volume of the liquid phase corresponding to the average level may be equal to the volume of liquid necessary for said multiphase pump to discharge from the tank any foreseeable volume of gaseous phase coming from the source considered and likely to enter the tank or surge drum by keeping the volumetric ratio of the effluents fed into the pump below a determined threshold (GLRmax) so as to allow application of said compression ($\Delta P$) to be applied to the effluents.

Determination of the volume and distribution of the apertures along the sample tube may be achieved by performing several successive stages:

a) according to the flow composition, the pressure prevailing in the tank or surge drum, the working temperature of the tank, the maximum value of the volumetric ratio (GLRmax) and a liquid phase level (Nd) defined previously and corresponding to this maximum value (GLRmax), the value of the ratio of the respective sections of flow provided for the gas and the liquid is determined, then distribution of the apertures along the sample tube is chosen as a function of said ratio, said distribution being achieved by zones, and b) a maximum limiting value is fixed for said volume of gaseous phase likely to enter the tank, then the liquid level (Nl) corresponding to this limiting value is determined, it is checked that this level of liquid is substantially the same as that corresponding to the average value of the volumetric ratio (GLR), and if need be at least one of the following two parameters is changed: the volume of the tank or the distribution of the apertures along the tube, until a value of the level of liquid (Nl) corresponding to the average value of the volumetric ratio is obtained.

At least one apertureion of the tube length is for example divided into several zones (Z1, . . . Z5) provided each with a particular aperture density (d1, . . . d5) and a aperture density which may range between 0 and a limiting value defined by the size and the shape of the apertures is selected for each zone.

The section of the pierced tube is for example increased by a value equal to the value of the increase in the gas-liquid mixing surface that is wanted, and an unpierced tube is introduced into said pierced tube so as to enable the total amount of gas that can pass through the apertures to mix with the oil.

The unpierced tube is introduced in such a way that the lower end of said unpierced tube opens below the lower end of the pierced tube.

The process in accordance with the invention may be applied to the manufacturing of an optimized device for regulating and damping the composition fluctuations of a multiphase flow, said flow comprising at least one gaseous phase and a liquid phase whose gas-liquid ratio is likely to vary within a range defined around an average value, said device being positioned between a source of effluents and a multiphase pump transmitting to the effluents a compression value (ΔP) necessary to the transfer of the effluents and comprising a tank or surge drum receiving said multiphase flow, which is provided with at least one sample tube 0 pierced with sampling apertures. The device is characterized in that the volume of the tank and the distribution of the apertures are selected in such a way that there is always in the tank at least a sufficient amount of liquid allowing discharge of any foreseeable volume of gas likely to enter the tank by keeping the value of the volumetric ratio of the multiphase flow lower than a fixed limiting value (GLRmax) so that the pump applies at least said compression (ΔP) to it.

The device may comprise an unpierced tube located inside the pierced tube, the lower end of the unpierced tube opening preferably below the lower end of the pierced tube.

In a preferred embodiment, the section of flow provided for the gas is r times as large as the flow section provided for the liquid, r being a coefficient determined from said fixed limiting value (GLRmax).

At least part of the tube length comprises several zones (Zi) of height (Hi) pierced with apertures, the density of the apertures (di) of each zone being selected so as to comply with a hyperbolic distribution function of form (ah+b)/(ch+d) where h is the height of the sample tube lying in gas and $H_r$ the overall height of the tank, coefficients a, b, c, d depending on the height (h) of the sample tube lying in gas, on the overall height ($H_r$) of the tank, on the heights (Hi) of each of the zones (Zi) and on the density (di) of the apertures of each of the zones.

The tube may comprise a central zone without apertures around the average interface level.

The density of the apertures of the lower zone of the tube is 1.

BRIEF DESCRIPTION OF THE DRAWINGS

Other features and advantages of the process and the tanks obtained with the process in accordance with the invention will be clear from reading the following description, with reference to the accompanying drawings in which.

DESCRIPTION OF THE PREFERRED EMBODIMENTS

The process described hereafter allows a regulating device comprising a tank or surge drum and a sample tube to be optimized according to the composition fluctuations of a multiphase fluid and to the characteristics of the pump located downstream.

Optimization provided by the process relates to the dimensioning and the lay-out of the elements constituting the tank and the definition of a piercing type, that is the distribution of the apertures along the sample tube. What is understood to be the lay-out of the elements is the selection of the various elements constituting the regulating device and their arrangement in relation to one another.

Figure 1:
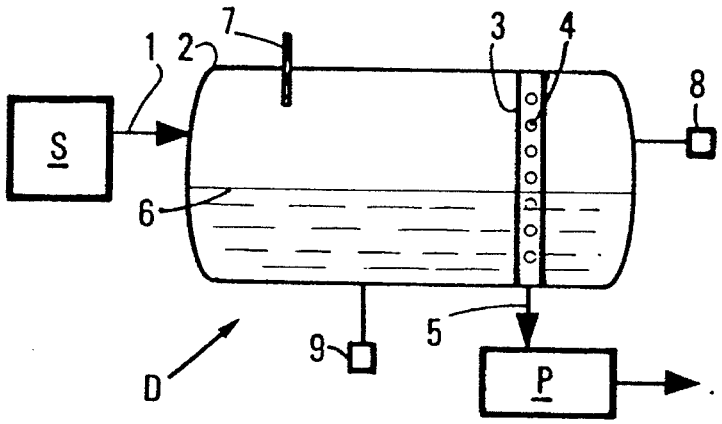
FIG. 1 shows a tank provided with a tube pierced with apertures.
Figure 5:
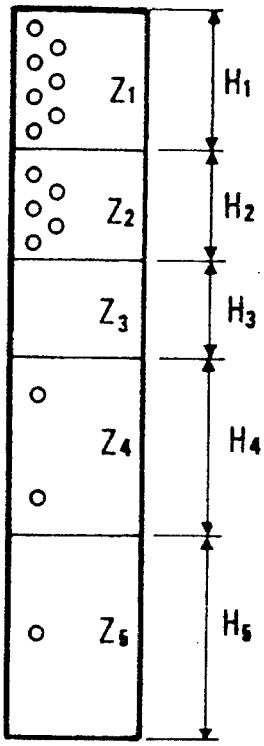
FIG. 5 shows an example of distribution of the apertures along the tube.

The multiphase fluid is conveyed from source S, such as an oil well head for example, through a pipe 1, to the inlet of a device D comprising a tank or surge drum 2 provided with a sample tube 3. Sample tube 3 is fitted with a plurality of apertures 4 distributed by zones over at least part of its length. The tube may for example be subdivided as shown in FIG. 5 into several zones Z1, Z2 . . . Z5 of height H1, H2 . . . H5, each zone Zi being provided with a constant aperture density d1 . . . d5 over its overall length.

Tube 3 is connected to a tube 5 for discharging the mixture towards pump P. Reference 6 refers to the liquid-gas interface. The tank is provided with measuring means such as a temperature sensor 7, a pressure sensor 8 and a level detector 9.

The various stages of the process in accordance with the invention are the following:

The first stage is a measurement stage where the characteristic parameters of the well to be developed are determined, such as the value of the average volumetric ratio GLR, estimated or measured at the beginning of the well development, the values of the densities for the liquid ρl and the gas ρg, and the parameters proper to the tank such as its working temperature T measured permanently by means of temperature sensor 7, the pressure Pbt prevailing in the tank measured by means of pressure sensor 8, its height $H_r$ and its length L, and the value Co of the piercing coefficient of the tube or hydrodynamic coefficient. Coefficient Co equals the ratio between the measured value of the ratio of the gas and liquid flow rates at a given pressure, for an interface level, and the value of the ratio of the sections of flow respectively provided for the gas and the liquid for the same interface level.

The compression (ΔP) which the pump has to apply to the effluents in order to compensate all the downstream pressure drops being known, the maximum value GLRmax of the volumetric ratio that should not be exceeded in order to keep at least this compression is determined in a way that is well-known by specialists.

A starting level Nd is fixed a priori, around which the interface of the gaseous phase and of the liquid phase corresponding to a height hmaxp of the pierced tube lying in gas must be situated in the tank. This level corresponds to the value GLRmax defined previously.

The ratio which must exist between the surface of flow provided for the gas Sg and the surface of flow provided for the liquid Sl is then determined for GLRmax by means of the function:

$$Sg/Sl = GLRmax * \sqrt{\frac{K1\ Pbt}{Co}}$$

K1 being a coefficient taking account of the working temperature of the tank and of the characteristics of the effluent. The ratio of the apertures reserved for the flow of gas and the flow of liquid is thus defined for the tube, and this ratio allows the required compression value (ΔP) to be provided by the pump.

When the ratio of the surfaces of the sections of flow provided respectively for the gas and for the liquid on each side of the starting level Nd has been determined, a piercing of the tube is then determined by imposing a priori the distribution of the apertures 4 along tube 3. This distribution is preferably achieved by dividing the length of the sample tube 3 into zones, the density of the apertures on each of them being constant.

Knowing the distribution of the apertures in each zone along the tube, it is possible to deduce the function f(h,H) characteristic of the piercing of the tube and representative of the ratio of the section of flow provided for the gas and of the section of flow provided for the liquid as a function of the height of the pierced tube lying in gas. This function may exhibit the form: (ah+b)/(ch+d), where h is the height of the tube lying in gas. In each zone, the coefficients a, b, c and d are determined from the height of the tube lying in gas, from the overall height of the pierced tube H, from the height of the tube zones and from the constant density selected for each zone.

The object of the next stage is to keep permanently in the tank an amount of liquid sufficient for the pump to discharge, with the compression value (ΔP) necessary to transfer the effluents, the largest foreseeable amount of gas coming from the source and likely to accumulate therein. The maximum foreseeable volume of this gas accumulation is thus previously appraised or estimated, considering the source producing it and the configuration of the pipe 1 between source S and the tank or surge drum 2.

Similarly, the value of the height of the tube hl lying in gas corresponding to a level Nl at the beginning of the discharge of the largest foreseeable gas volume is estimated. The height of the pierced tube lying in gas at the end of the discharge of the largest foreseeable gas volume is taken as equal to the value hmax defined previously and corresponding to a level Nd. The heights of the part of the tube lying in gas are measured or estimated, in our example, from the top of the tank.

The level of liquid corresponding to the volume necessary to the discharge of the largest foreseeable gas volume is then determined as follows:

The shape, the size of the tank and the function f(h,H) of distribution of the apertures along the pierced tube are taken into account. The amount of discharged gas is deduced for an increment dh of tube height lying in gas, knowing that the amount of discharged gas dVg equals at any time the product of an elementary amount of liquid dVl by the value of ratio GLR, which varies with the height h of the tube lying in gas, the coefficient Co, the dimensions of the tank, the characteristics of the effluent, the pressure and the temperature prevailing in the tank. It is obvious that the elementary amount of liquid dVl is here the product of the surface of the tank at the height h by the height increment dh.

Thus, in case of a cylindric tank or drum whose axis is horizontal, we have:

$$\begin{aligned} dVg &= GLR(h) \cdot dVl \\ &= 2 \cdot GLR(h) \cdot L \cdot \sqrt{H_r h - h^2} \cdot dh \end{aligned}$$

The amount of gas Vg discharged is obtained by integrating this product between the two values hl and hmax. It is checked that the value Vg obtained corresponds to the value of the largest foreseeable gas volume Vgm estimated at the beginning and, if necessary, at least one of the parameters defining the size of the tank is changed until a volume of discharged gas Vg substantially equal to Vgm is obtained. The last value obtained for hl corresponds to the height that has to be at the beginning of the discharge of the largest foreseeable gas volume. This value hl defines the average level of liquid Nl above which the liquid phase has to be situated to discharge any foreseeable amount of gas likely to enter the tank.

It is then checked, by means of the function of distribution of the apertures along the pierced tube, that the level Nl determined previously corresponds to the average value of the GLR ratio set during the first stage.

In case the value Nl is different, at least one of the following parameters is modified: the volume of the tank, by changing either its height $H_r$, or its length L or both, or the distribution of the sampling apertures along the tube until a value corresponding to the average value of the GLR set during the first stage is obtained for level Nl.

The volume of the tank and the distribution of the apertures along the sample tube per zone of constant aperture density are thus determined, so that the liquid-gas interface is stabilized, during normal operation, substantially at the average level corresponding to the average value of the average ratio GLR. A sufficient reserve is thus provided in the tank to discharge any large foreseeable amount of gas likely to enter the tank.

Moreover, this way of proceeding enables to have a value GLRmax for the pump to apply to the effluents a compression (P) necessary to transfer the effluents.

The method for predimensioning a tank and the sample tube associated to it, described previously, is suited when the maximum foreseeable amount of gas Vgm estimated at the beginning is small. In case the foreseeable gas volume to be transferred is large, experience has shown that the amount of gas mixing with oil in the pierced tube is smaller than the amount that should theoretically mix, this amount depending on the number of apertures pierced in the tube lying in gas. To overcome this drawback, it has been noticed that division of the flow of gas entering the tube in such a way that the gas-liquid mixing takes place in several places of the tube increases the amount of gas mixing with oil.

Figure 2:
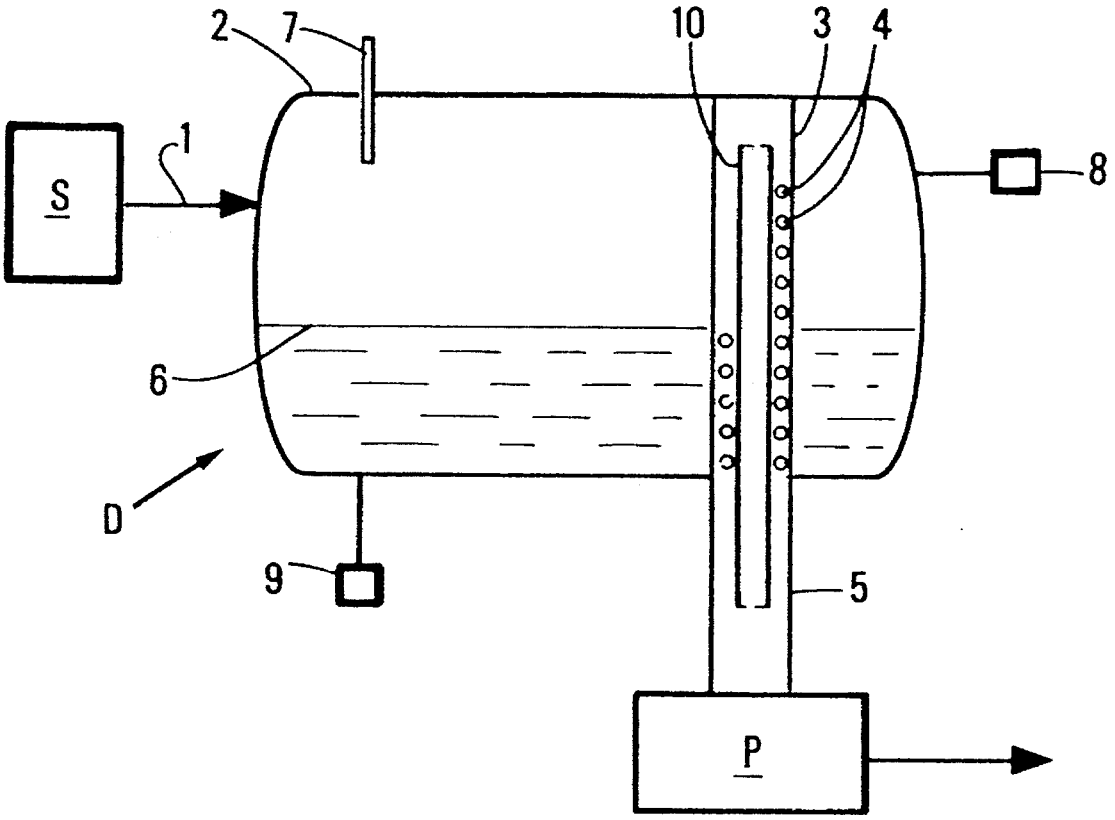
FIG. 2 shows the device of FIG. 1 adapted more particularly to large gas volumes.

The gas flow is divided by introducing inside the pierced tube 3 an additional tube 10 (FIG. 2) whose diameter is smaller than that of the pierced tube and whose length is such that the lower end of this tube opens into the sample pipe, so that mixing of the gas escaping through the lower end of the additional tube with the fluid situated in this part of the sample tube takes place in a location where the pressure is lower than the pressure prevailing in the part of the pierced tube only containing gas. The gas thus mixes both in the annulus between the pierced tube and the unpierced tube and in a place situated close to the lower part of the unpierced tube. The gas-liquid mixing surface is therefore increased and a possible "saturation" process, that is any process preventing the total amount of gas from mixing with the liquid in the pierced tube, is thus prevented.

The method described above comprises the following additional stages:

the section of the pierced tube, previously defined as having a value equal to the increase in the exchange surface between the gas and the liquid to be obtained, is widened, a tube, preferably unpierced, is introduced inside the pierced tube, the section of said tube being equal to the increase necessary for the exchange surface, which allows the gas flow to be divided.

The value of the increase in the exchange surface is defined as a function of the maximum foreseeable amount of gas. Tests achieved previously make it possible to draw a chart giving, according to the maximum foreseeable amount of gas, the section of the unpierced tube that is to be inserted into the pierced tube so that mixing of the gas with the liquid takes place under optimum conditions.

Figure 3:
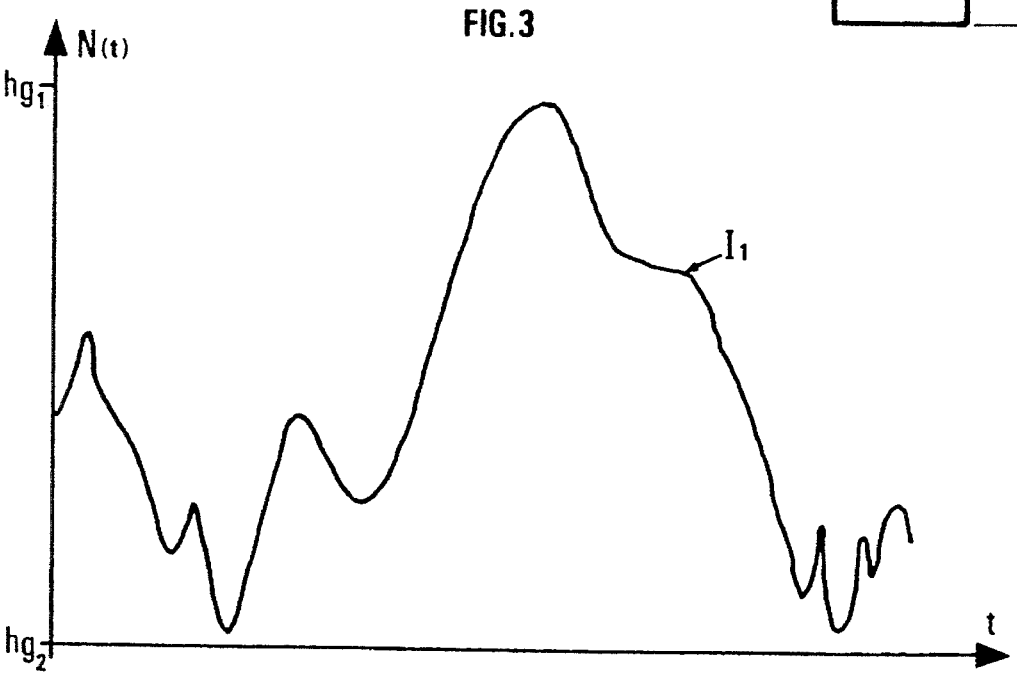
FIG. 3 shows a curve relating to the variation in time of the level of the liquid-gas interface in the tank.
Figure 4:
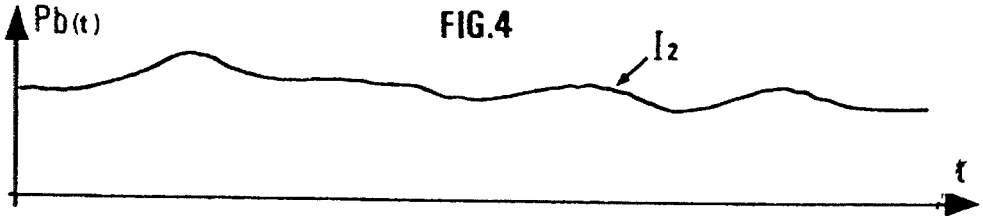
FIG. 4 shows a curve relating to the variation in time of the pressure Pbt prevailing in the tank or surge drum.

FIGS. 3 and 4 show curves recorded during tests achieved on site using a multiphase type pump such as that described in patent application FR-90/09,607, associated with an optimized tank and sample tube. Curve I1 (FIG.3) shows the variation in time of the interface level N, the value of the height hg1 corresponds to the height of the tube lying in gas at the beginning of the discharge of an amount of gas and the value hg2 refers to the height of the pierced tube lying in gas at the end of the discharge of the amount of gas.

Curve I2 (FIG. 4) shows the variation in time of the value of the pressure Pbt prevailing in tank 2.

The tube shown in FIG. 5 by way of example comprises five zones Z1–Z5 having respectively the following aperture densities: d1=7, d2=6, d3=0, d4=2 and d5=1.

These values correspond to an optimized tube set on site during tests performed with a pump such as that described in the application FR-90/09,607 mentioned above.

The zone around the average value comprises no apertures, so that the variations of GLR are not passed on as long as the level of the liquid-gas interface has not moved by a certain value until it reaches an adjacent zone Z2 or Z4.

This embodiment example is in no way limitative, and the sampling apertures may have a shape other than circular. Any other shape may therefore be envisaged, such as for example the shapes described in the French patent FR-2, 642,539 cited above.

Various changes and/or additions may of course be provided to the process which has been described by way of non limitative example, without departing from the scope of the invention.

I claim:

1. A device for regulating and for damping the composition fluctuations of a multiphase flow, said flow comprising at least one gaseous phase and a liquid phase and having a liquid-gas ratio likely to vary within a range defined around an average value, said device being positioned between a source of effluents and a multiphase pump transmitting to the effluents a compression value (ΔP) necessary to transfer the effluents and comprising a tank receiving said multiphase flow, said tank being provided with at least one sample tube pierced with sampling apertures, means for measuring temperature in the tank, means for measuring pressure in the tank and means for detecting a level of liquid in the tank, the tank having a volume and the apertures having a distribution on the sample tube predetermined whereby at least a sufficient amount of liquid is in the tank for allowing discharge of any foreseeable gas volume likely to enter the tank by keeping the value of the volumetric ratio of the multiphase flow lower than a fixed limiting value (GLRmax) so that the pump applies at least said compression (ΔP) to said effluents; the volume of the tank and the distribution of the apertures being predetermined through the following successive stages:

a) according to the flow composition, the pressure prevailing in the tank measured by the pressure means, the working temperature of the tank measured by the temperature measuring means, the maximum value of the volumetric ratio (GLRmax) and a liquid phase level (Nd) defined previously and corresponding to this maximum value (GLRmax), the value of the ratio of the respective sections of flow provided for the gas and the liquid is determined, then a distribution of the apertures along the sample tube is chosen as a function of said ratio, said distribution being achieved by zones, and b) a maximum limiting value is fixed for said volume of gaseous phase likely to enter the tank, the level of liquid (Nl) corresponding to this limiting value is then determined, it is checked that this level of liquid is substantially the same as that corresponding to the average value of the volumetric ratio (GLR), and at least one of the following two parameters is changed: the volume of the tank or the distribution of the apertures along the tube, until a value of the level of liquid (Nl), corresponding to the average value of the volumetric ratio is obtained.

2. A device as claimed in claim 1, comprising an unpierced tube located inside the pierced sample tube, a lower end of the unpierced tube opening below a lower end of the pierced sample tube.

3. A device as claimed in claim 1, wherein a section of flow provided for the gas is r times as large as a flow section provided for the liquid, r being a coefficient determined from said fixed limiting value (GLRmax).

4. A device as claimed in claim 1, wherein at least part of a length of the pierced sample tube comprises several zones of height pierced with apertures, aperture density of each zone being selected so to comply with a hyperbolic distribution function of form (ah+b)/(ch+d), where h is the height of the sample tube lying in gas and $H_r$ is the overall height of the tank, the coefficients a, b, c, d depending on the height of the sample tube lying in gas, on the overall height of the tank ($H_r$), on the height of each of the zones and on the aperture density of each zone.

5. A device as claimed in claim 1, wherein the sample tube comprises a central zone without apertures around an average interface level.

6. A device as claimed in claim 1, wherein the density of the apertures in the lower zone of the sample tube is 1.

* * * * *